United States Patent [19]

Waynick

[11] Patent Number: 5,000,862

[45] Date of Patent: Mar. 19, 1991

[54] PROCESS FOR PROTECTING BEARINGS IN STEEL MILLS AND OTHER METAL PROCESSING MILLS

[75] Inventor: John A. Waynick, Bolingbrook, Ill.

[73] Assignee: Amoco Corporation, Chicago, Ill.

[21] Appl. No.: 332,509

[22] Filed: Mar. 31, 1989

[51] Int. Cl.[5] ..... C10M 125/10

[52] U.S. Cl. ..... 252/11; 252/12.2; 252/18; 252/25; 72/42; 72/43

[58] Field of Search ..... 252/11, 25, 18, 12.2; 72/42, 43

[56] References Cited

U.S. PATENT DOCUMENTS 3,757,554 9/1973 Kida et al. ..... 72/43
3,846,315 11/1974 Staton et al. ..... 252/25
4,630,352 12/1986 Ginzburg et al. ..... 72/227
4,675,974 6/1987 Connolly ..... 72/200
4,904,399 2/1990 Waynick ..... 252/11

*Primary Examiner*—Jacqueline V. Howard
*Attorney, Agent, or Firm*—Thomas W. Tolpin; Ralph C. Medhurst; William H. Magidson

[57] ABSTRACT

A process is provided for lubricating and protecting bearings in steel and process mills. In the process, metal is processed in the mill and conveyed on caster rollers. The caster rollers are lubricated with a special grease which enhances the longevity of the rollers, protects the rollers from rust and corrosion, and prevents the grease from leaking out of the rollers. In the preferred form, the grease comprises a water-resistant polymer to prevent the grease from washing out of the rollers and bearings when the metal workpiece is quenched with a high pressure water spray.

11 Claims, No Drawings

PROCESS FOR PROTECTING BEARINGS IN STEEL MILLS AND OTHER METAL PROCESSING MILLS

BACKGROUND OF THE INVENTION

This invention pertains to steel mills and, more particularly, to a process for protecting bearings in steel mills.

In steel mills, hot molten steel is formed into slabs in a hot steel slab caster. In slab casters, molten steel enters a formation chamber. One or more steel slabs emerge from the formation chamber with a thin skin of solidified steel holding them together. The steel emerging from the formation chamber can be in the form of a series of discrete slabs or, alternatively, as one unbroken slab which is cut into discrete slabs at the far end of the slab caster. This latter process is characteristic of the more modern facilities and is usually referred to as a continuous caster. Steel slabs can vary in width and thickness depending on the particular steel mill, but a standard width for a single strand of steel on a continuous caster is about six feet with a thickness of 9–12 inches. Steel slabs, once cut, are typically about 25 feet long.

In order to convey the steel slab from the formation chamber, the slab is supported by a series of rotatable caster rollers. Each of these caster rollers has a bushing or bearing, usually a tapered roller bearing, at each end which allows the caster roller to turn. The line or lines of caster rollers in steel mills can be as long as three miles with a caster roller every two feet. Such a line or lines can use three million pounds of grease per year. Because the caster rollers are not much wider than the steel slab it supports, the steel slab typically comes within only a very few inches of the bearings. The bearings and grease used to lubricate those bearings experience very high thermal stress, with the steel slab surface often irradiating at temperatures of 1,500° F. to 2,000° F. Also, steel slabs exert a large force on each caster roller due to the heavy weight of the slabs causing high loading pressures on the bearings and bearing grease.

High performance greases are important to minimize failure of the caster bearings. Such bearing failures will cause the caster to stop rotating under the progressing steel slab. If this occurs, the dragging force between the slab surface and the nonrotating caster roller can rupture the slab skin causing a breakout which can endanger operating personnel, damage property and interrupt steel mill operations and production.

For example, when the hot steel slab moves along the series of caster rollers, the slab is quickly quenched and cooled to strengthen and thicken the solid skin of the slab. If quenching is not done properly, the tenuous skin can rupture causing molten steel to flow out onto the caster rollers, bearing housings, and eventually the plant floor. Such an occurrence (breakout) is very costly in terms of plant downtime and maintenance cost. To minimize breakouts, rapid quenching, cooling and strengthening of the skin is accomplished by high velocity water spray from all directions. The spray velocity can be as high as 1,000 gallons per minute. With such water spray force, even well sealed bearings will not totally exclude water. Therefore, the bearing grease will experience water contamination with a physical force that tends to wash (flush) the grease out of the bearings.

Another problem associated with conventional steel mill greases which is becoming of great concern is the increasing number and intensity of grease fires. Grease fires can occur from hot molten metal, from acetylene torches during periodic maintenance, and from other sources of ignition. Grease fires can be costly in terms of loss of equipment, operational downtime, and loss of life. It is highly desirable to have a high performance steel mill grease which also reduces the occurrence of grease fires.

Once formed and sufficiently cooled, steel slabs can be fabricated into other more commercially useful forms in process mills, such as hot strip mills, cold strip mills, billet mills, plate mills, and rod mills. Although the lubricant environment for process mills are not as severe as slab casters, grease specifications are quite stringent because of the high operating temperature and extreme pressure, antiwear requirements. Grease mills which purify, form, and process other metals such as aluminum encounter many similar problems as steel mill greases.

Preferably, the grease used to lubricate the bearings of hot slab casters should: (a) reduce wear and friction; (b) prevent rusting even in presence of water sprays; (c) be passive, non-corrosive, and unreactive with the bearing material; (d) resist being displaced by high velocity water sprays; and (e) maintain the integrity of its chemical composition and resulting performance properties under operating conditions near thermal sources which irradiate at temperatures of 1,500° F. to 2,000° F.

In order to enhance the safety, health, and welfare of operating personnel, greases used in steel mills should be non-toxic, reduce the incidence of grease fires, and be of a safe composition. Materials known to be serious skin irritants, carcenogenic, and mutogenic should be avoided in steel mill greases.

Grease used to lubricate tapered roller bearings of slab casters and process mills in steel mills should desirably have good adherence properties as well as resist displacement by water spray. The grease should retain these properties during use without exhibiting any adverse effects such as lacquer deposition on the tapered roller bearing parts due to high temperature oxidation, thermal breakdown, and polymerization of the lubricating grease. Such lacquering problems have been a common occurrence in hot slab casters especially where aluminum complex and lithium complex thickened greases have been used. When such lacquering becomes severe enough, the results are similar to rusting: the caster bearing fails and a breakout can occur.

Since hot slab caster bearing grease may be used in other applications in the steel mill, additional properties such as good elastomer compatibility and protection against other types of wear such as fretting wear is desirable. Also, many steel manufacturers prefer a grease which would work well in slab casters and in process mills, thereby allowing a multi-use consolidation of lubricants and a reduction in lubricant inventory.

Over the years, a variety of greases and processes have been suggested for use in steel mills and other applications. Typifying such greases and processes are those found in U.S. Pat. Nos. 2,964,475, 2,967,151, 3,344,065, 3,843,528, 3,846,314, 3,920,571, 4,107,058, 4,305,831, 4,431,552, 4,440,658, 4,514,312, and Re. 31,611. These prior art greases and processes have met with varying degrees of success. None of these prior art greases and processes, however, have been successful in simultaneously providing all the above stated properties at the high performance levels required in steel mills.

It is, therefore, desirable to provide an improved process which overcomes many, if not all, of the preceding problems.

SUMMARY OF THE INVENTION

A process is provided in which steel or other metal can be formed, treated, fabricated, worked, or otherwise processed in a steel mill or a process mill, such as a hot strip mill, cold strip mill, billet mill, plate mill, or rod mill, and conveyed on caster rollers with bearings. In the preferred process, the described special high performance grease is injected into and prevented from leaking out of the bearings so as to lubricate and enhance the longevity and useful life of the bearings. Desirably, the bearings are protected against rust and corrosion at high temperatures during casting, working, fabricating, and other processing, as well as at lower and ambient temperatures. In the preferred process, this is accomplished by the described special non-corrosive, oxidatively stable, thermally stable, adhesive-imparting grease which also hermetically seals the bearings, substantially eliminates grease leakage and toxic emissions, and does not normally irritate the skin or eyes of workers in the mill. Advantageously, substantially less grease is required, consumed, and used with the described special grease.

In steel mills, molten steel is fed to a formation chamber where it is formed into a hot steel slab and discharged on a slab caster. The hot steel slab is conveyed on caster rollers with tapered roller bearings. The hot steel slab is quenched and cooled with a high velocity water spray from above and below the caster rollers and bearings. Advantageously, the special high performance grease prevents the grease from being flushed and washed out of the bearings.

The improved high performance lubricating grease is particularly useful to lubricate caster bearings in hot slab casters and process mills, especially of the type used in steel mills. This novel grease composition exhibited surprisingly good results over prior art grease compositions.

Desirably, the new grease provides superior wear protection under low loads as well as under high loads. The new grease also reduces friction and prevents rusting under prolonged wet conditions. Desirably, the novel grease is substantially nonreactive, non-corrosive, and passive to ferrous and nonferrous metals at ambient and metal processing temperatures, resists displacement by water spray, and minimizes water contamination. The grease also retains its chemical composition for extended periods of time under operating conditions.

Advantageously, the novel grease and process produced unexpectedly good results and achieved unprecedented levels of high performance during extensive testing on hot steel slab casters by a major U.S. steel producer. Significantly, during the tests water contamination levels in the caster bearings and rotatable caster rollers were reduced by about 90% with the novel grease, thereby virtually eliminating wear, rust, and corrosion in the bearings of the slab casters. Also, breakouts on the casting line were prevented and downtime was significantly decreased with the subject grease.

Another significant benefit of the subject steel mill grease and process are that they decrease the amount of grease used (grease consumption) by over 80% in comparison to the amount of conventional steel mill greases previously used.

Desirably, the novel grease and process perform well at high temperatures and over long periods of time. The grease also exhibits excellent stability, superior wear prevention qualities, and good oil separation properties even at high temperatures. Furthermore, the grease is economical to manufacture and can be produced in large quantities.

In use, the improved lubricating grease is periodically and frequently injected into rotatable caster rollers and particularly the tapered caster roller bearings of slab casters in steel mills which are subject to extreme thermal stresses by supporting the heavy loads of hot steel slabs while being substantially continuously quenched (sprayed) with water or some other liquid at high pressure and velocities. The improved lubricating grease can also be injected into the bearings and caster rollers of process mills, such as hot strip mills, cold strip mills, strip mills, billet mills, plate mills, and rod mills, or other metal forming mills, such as aluminum mills.

The improved lubricating grease has: (a) a substantial proportion of a base oil, (b) a thickener, such as polyurea, triurea, biurea or combinations thereof, (c) a sufficient amount of an additive package to impart extreme pressure antiwear properties to the grease, (d) a boron-containing material to inhibit oil separation especially at high temperatures, and (e) a sufficient amount of a high temperature, non-corrosive, oxidatively stable, thermally stable, water-resistant, hydrophobic, adhesive-imparting polymeric additive in the absence of sulfur. The polymeric additive cooperates and is compatible (non-interfering) with the extreme pressure antiwear additive package to minimize water contamination in the grease as well as resist displacement by water spray while not adversely affecting low temperature mobility properties of the grease.

The polymeric additive can comprise: polyesters, polyamides, polyurethanes, polyoxides, polyamines, polyacrylamides, polyvinyl alcohol, ethylene vinyl acetate, or polyvinyl pyrrolidone, or copolymers, combinations, or boronated analogs (compounds) of the preceding. Preferably, the polymeric additive comprises: olefins (polyalkylenes), such as polyethylene, polypropylene, polyisobutylene, ethylene propylene, and ethylene butylene; or olefin (polyalkylene) arylenes, such as ethylene styrene and styrene isoprene; polyarylene such as polystyrene; or polymethacrylate.

In one form, the extreme pressure antiwear (wear-resistant) additive package comprises tricalcium phosphate in the absence of sulfur compounds, especially oil soluble sulfur compounds. Tricalcium phosphate provides many unexpected advantages over monocalcium phosphate and dicalcium phosphate. For example, tricalcium phosphate is water insoluble and will not be extracted from the grease if contacted with water. Tricalcium phosphate is also very nonreactive and non-corrosive to ferrous and nonferrous metals even at very high temperatures. It is also nonreactive and compatible with most if not all of the elastomers in which lubricants may contact.

On the other hand, monocalcium phosphate and dicalcium phosphate are water soluble. When water comes into significant contact with monocalcium or dicalcium phosphate, they have a tendency to leach, run, extract, and washout of the grease. This destroys any significant antiwear and extreme pressure qualities of the grease. Monocalcium phosphate and dicalcium phosphate are also protonated and have acidic hydrogen present which can at high temperature adversely react and corrode ferrous and nonferrous metals as well as degrade many elastomers.

In another form, the extreme pressure antiwear additive package comprises carbonates and phosphates together in the absence of sulfur compounds including oil soluble sulfur compounds and insoluble arylene sulfide polymers. The carbonates and phosphates are of a Group 2a alkaline earth metal, such as beryllium, magnesium, calcium, strontium, and barium, or of a Group la alkali metal, such as lithium, sodium, potassium, rubidium, cesium, and francium. Calcium carbonate and tricalcium phosphate are preferred for best results because they are economical, stable, nontoxic, water insoluble, and safe.

The use of both carbonates and phosphates in the additive package produced unexpected surprisingly good results over the use of greater amounts of either carbonates alone or phosphates alone. For example, the use of both carbonates and phosphates produced superior wear protection in comparison to a similar grease with a greater amount of carbonates in the absence of phosphates, or a similar grease with a greater amount of phosphates in the absence of carbonates. Furthermore, the synergistic combination of calcium carbonate and tricalcium phosphate can reduce the total additive level over a single additive and still maintain superior performance over a single additive.

Furthermore, the combination of the above carbonates and phosphates in the absence of insoluble arylene sulfide polymers achieved unexpected surprisingly good results over that combination with insoluble arylene sulfide polymers. It was found that applicant's combination attained superior extreme pressure properties and antiwear qualities as well as superior elastomer compatibility and non-corrosivity to metals, while the addition of insoluble arylene sulfide polymers caused abrasion, corroded copper, degraded elastomers and seals, and significantly weakened their tensile strength and elastomeric qualities. Insoluble arylene sulfide polymers are also very expensive, making their use in lubricants prohibitively costly.

The use of sulfur compounds, such as oil soluble sulfur-containing compounds, should generally be avoided in the additive package of steel mill greases because they are chemically very corrosive and detrimental to the metal bearing surfaces at the high temperatures encountered in hot slab casters. Oil soluble sulfur compounds often destroy, degrade, or otherwise damage caster bearings by high temperature reaction of the sulfur with the internal bearing parts, thereby promoting wear, corrosion, and ultimately failure of the bearings. Such bearing failures can actually cause a breakout which can result in complete shut-down of the hot slab caster. Oil soluble sulfur compounds are also very incompatible with elastomers and will typically destroy them at elevated temperatures.

While the novel lubricating grease is particularly useful for steel mill and process mill lubrication, especially lubrication of caster bearings, it may also be advantageously used in the constant velocity joints of front-wheel or four-wheel drive cars. The grease may also be used in universal joints and bearings which are subjected to heavy shock loads, fretting, and oscillating motions. It may also be used as the lubricant in sealed-for-life automotive wheel bearings. Furthermore, the subject grease can also be used as a railroad track lubricant on the sides of a railroad track.

The application also discloses a process for preventing grease fires, which is especially useful in steel mills and other metal processing mills, such as strip mills, billet mills, plate mills, and rod mills. In the process, when a flame is ignited, such as from molten steel or other hot metal or from acetylene torches, or other welding equipment, and approaches near and contacts the described special grease, which can be injected into the caster bearings or rollers in a metal processing mill, the special grease emits a sufficient amount of carbon dioxide to blanket and extinguish the flame or otherwise substantially prevent the grease from igniting, burning, and combusting. In the preferred process, carbon dioxide is emitted from thermal decomposition of calcium carbonate in the grease.

As used in this application, the term "polymer" means a molecule comprising one or more types of monomeric units chemically bonded together to provide a molecule with at least six total monomeric units. The monomeric units incorporated within the polymer may or may not be the same. If more than one type of monomer unit is present in the polymer the resulting molecule may be also referred to as a copolymer.

The term "bearing" as used in this application includes bushings.

A more detailed explanation of the invention is provided in the following description and appended claims.

DETAILED DESCRIPTION OF THE PREFERRED EMBODIMENT

A high performance lubricating grease and process are provided to effectively lubricate the caster bearings of hot steel slab casters, hot strip mills, cold strip mills, billet mills, plate mills, rod mills, and other process units used in commercial steel mills. The novel steel mill grease exhibits excellent extreme pressure (EP) properties and antiwear qualities, resists displacement by water, prevents rusting even in a constant or prolonged wet environment, and is economical, nontoxic, and safe. Desirably, the steel mill grease is chemically inert to steel even at the high temperatures which can be encountered in hot steel slab casters.

Advantageously, the steel mill grease is chemically compatible and substantially inert to the elastomers and seals commonly used in other parts and operations common to steel mills, thereby increasing its utility. Also, the grease will not significantly corrode, deform, or degrade silicon-based elastomers nor will it significantly corrode, deform, or degrade silicone-based seals with minimal overbasing from calcium oxide or calcium hydroxide. Furthermore, the grease will not corrode, deform, or degrade polyester and neoprene elastomers.

The preferred lubricating grease comprises by weight: 45% to 85% base oil, 6% to 16% polyurea thickener, 2% to 30% extreme pressure wear-resistant additives, 0.1% to 5% boron-containing material for inhibiting oil separation, and 1% to 10% of a high temperature non-corrosive, thermally stable, oxidatively stable water-resistant, hydrophobic, adhesive-imparting, high performance polymeric additive. The polymeric additive also promotes good low temperature grease mobility for outside tank storage and transportation. For best results, the steel mill lubricating grease comprises by weight: at least 70% base oil, 8% to 14% polyurea thickener, 4% to 16% extreme pressure wear-resistant additives, 0.25% to 2.5% boron-containing material for inhibiting oil separation, and 2% to 6% polymeric additives. The polymeric additives are compatible (non-interfering) with the extreme pressure wear-resistant additives so as to not adversely affect the positive performance characteristics of the extreme pressure wear-resistant additives.

Sulfide polymers, such as insoluble arylene sulfide polymers, should be avoided in the grease because they: (1) corrode copper, steel, and other metals, especially at high temperatures, (2) degrade, deform, and corrode silicon seals, (3) significantly diminish the tensile strength and elastomeric properties of many elastomers, (4) exhibit inferior fretting wear, and (5) are abrasive.

Sulfur compounds, such as oil soluble sulfur compounds, can be even more aggravating, troublesome, and worse than oil insoluble sulfur compounds. Sulfur compounds and especially oil soluble sulfur compounds should be generally avoided in the grease because they are often chemically incompatible and detrimental to silicone, polyester, and other types of elastomers and seals. Oil soluble sulfur compounds can destroy, degrade, deform, chemically corrode, or otherwise damage elastomers and seals by significantly diminishing their tensile strength and elasticity.

Furthermore, oil soluble sulfur compounds are extremely corrosive to copper, steel and other metals at the very high temperatures experienced in steel mills. Such chemical corrosivity is unacceptable in steel mills.

Generally, any sulfur-containing compounds should be avoided in the additive composition of the steel mill grease, especially the sulfurized hydrocarbons and organometallic sulfur salts. Sulfur compounds of the type to be avoided in the grease include saturated and unsaturated aliphatic as well as aromatic derivatives that have from 1 to 32 or 1 to 22 carbon atoms. Included in this group of oil soluble sulfur compounds to be avoided in the grease are alkyl sulfides and alkyl polysulfides, aromatic sulfides and aromatic polysulfides, e.g. benzyl sulfide and dibenzyl disulfide, organometallic salts of sulfur containing acids such as the metal neutralized salts of dialkyl dithiophosphoric acid, e.g. zinc dialkyl dithiophosphate, as well as phosphosulfurized hydrocarbons and sulfurized oils and fats. Sulfurized and phosphosulfurized products of polyolefins are very detrimental and should be avoided in the grease. A particularly detrimental group of sulfurized olefins or polyolefins are those prepared from aliphatic or terpenic olefins having a total of 10 to 32 carbon atoms in the molecule and such materials are generally sulfurized such that they contain from about 10 to about 60 weight percent sulfur.

The aliphatic olefins to be avoided in the grease include mixed olefins such as cracked wax, cracked petrolatum or single olefins such as tridecene-2, octadecene-1, eikosene-1 as well as polymers of aliphatic olefins having from 2 to 5 carbon atoms per monomer such as ethylene, propylene, butylene, isobutylene and pentene.

The terpenic olefins to be avoided in the grease include terpenes ($C_{10}H_{16}$), sesquiterpenes ($C_{15}H_{24}$) and diterpenes ($C_{20}H_{32}$). Of the terpenes, the monocyclic terpenes having the general formula $C_{10}H_{16}$ and their monocyclic isomers are particularly detrimental.

INHIBITORS

The additive package may be complemented by the addition of small amounts of an antioxidant and a corrosion inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl)amine, N,N - diphenyl-p-phenylenediamine, 2,2,4 - trimethyldihydroquinoline oligomer, bis(4 - isopropylaminophenyl)-ether, N-acyl-p-aminophenol, N - acylphenothiazines, N of ethylenediamine tetraacetic acid, and alkylphenol-formaldehyde-amine polycondensates.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion. Likewise, substituted amides, imides, amidines, and imidazolines can be used to limit ferrous corrosion. Other ferrous corrosion inhibitors include certain salts of aromatic acids and polyaromatic acids, such as zinc naphthenate.

Metal deactivators can also be added to further prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines. Although such metal deactivators can be added to the grease, their presence is not normally required due to the extreme nonreactive, noncorrosive nature of the steel mill grease composition.

Stabilizers, tackiness agents, dropping-point improvers, lubricating agents, color correctors, and/or odor control agents can also be added to the additive package.

BASE OIL

The base oil can be naphthenic oil, paraffinic oil, aromatic oil, or a synthetic oil such as a polyalphaolefin polyolester, diester, polyalkyl ethers, polyaryl ethers, silicone polymer fluids, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) olefin (alkylene) oxide-type polymers, such as olefin (alkylene) oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl)siloxane, and poly(methyl)phenylsiloxane.

The preferred base oil comprises about 60% by weight of a refined solvent-extracted hydrogenated dewaxed base oil, preferably 850 SUS oil, and about 40% by weight of another refined solvent-extracted hydrogenated dewaxed base oil, preferably 350 SUS oil, for better results.

THICKENER

Polyurea thickeners are preferred over other types of thickeners because they have high dropping points, typically 460° F. to 500° F., or higher. Polyurea thickeners are also advantageous because they have inherent antioxidant characteristics, work well with other antioxidants, and are compatible with all elastomers and seals.

The polyurea comprising the thickener can be prepared in a pot, kettle, bin, or other vessel by reacting an amine, such as a fatty amine, with diisocyanate, or a polymerized diisocyanate, and water. Other amines can also be used.

Biurea (diurea) may be used as a thickener, but it is not as stable as polyurea and may shear and loose consistency when pumped. If desired, triurea can also be included with or used in lieu of polyurea or biurea.

ADDITIVES

In order to attain extreme pressure properties, antiwear qualities, and elastomeric compatibility, the additives in the additive package comprise tricalcium phosphate and calcium carbonate in the absence of sulfur compounds. Advantageously, the use of both calcium carbonate and tricalcium phosphate in the additive package adsorbs oil in a manner similar to polyurea and, therefore, less polyurea thickener is required to achieve the desired grease consistency. Typically, the cost of tricalcium phosphate and calcium carbonate are much less than polyurea and, therefore, the grease can be formulated at lower costs.

Preferably, the tricalcium phosphate and the calcium carbonate are each present in the additive package in an amount ranging from 1% to 15% by weight of the grease. For ease of handling and manufacture, the tricalcium phosphate and calcium carbonate are each most preferably present in the additive package in an amount ranging from 2% to 8% by weight of the grease.

Desirably, the maximum particle sizes of the tricalcium phosphate and the calcium carbonate are 100 microns and the tricalcium phosphate and the calcium carbonate are of food-grade quality to minimize abrasive contaminants and promote homogenization. Calcium carbonate can be provided in dry solid form as $CaCO_3$. Tricalcium phosphate can be provided in dry solid form as $Ca_3(PO_4)_2$ or $3Ca_3(PO_{42}.Ca(OH)_2$.

If desired, the calcium carbonate and/or tricalcium phosphate can be added, formed, or created in situ in the grease as by-products of chemical reactions. For example, calcium carbonate can be produced by bubbling carbon dioxide through calcium hydroxide in the grease. Tricalcium phosphate can be produced by reacting phosphoric acid with calcium oxide or calcium hydroxide in the grease. Other methods for forming calcium carbonate and/or tricalcium phosphate can also be used.

The preferred phosphate additive is tricalcium phosphate for best results. While tricalcium phosphate is preferred, other phosphate additives can be used, if desired, in conjunction with or in lieu of tricalcium phosphate, such as the phosphates of a Group 2a alkaline earth metal, such as beryllium, magnesium, calcium, strontium, and barium, or the phosphates of a Group la alkali metal, such as lithium, sodium, and potassium.

Desirably, tricalcium phosphate is less expensive, less toxic, more readily available, safer, and more stable than other phosphates. Tricalcium phosphate is also superior to monocalcium phosphate and dicalcium phosphate. Tricalcium phosphate has unexpectedly been found to be noncorrosive to metals and compatible with elastomers and seals. Tricalcium phosphate is also water insoluble and will not washout of the grease when contamination by water occurs. Monocalcium phosphate and dicalcium phosphate, however, have acidic protons which at high temperatures can corrosively attack metal surfaces such as found in the caster bearings of hot steel slab casters. Monocalcium phosphate and dicalcium phosphate were also found to corrode, crack, and/or degrade some elastomers and seals. Monocalcium phosphate and dicalcium phosphate were also undesirably found to be water soluble and can washout of the grease when the caster bearing is exposed to the constant high velocity water spray of slab casters, which would significantly decrease the antiwear and extreme pressure qualities of the grease.

The preferred carbonate additive is calcium carbonate for best results. While calcium carbonate is preferred, other carbonate additives can be used, if desired, in conjunction with or in lieu of calcium carbonate, such as the carbonates of Group 2a alkaline earth metal, such as beryllium, magnesium, calcium, strontium, and barium.

Desirably, calcium carbonate is less expensive, less toxic, more readily available, safer, and more stable than other carbonates. Calcium carbonate is also superior to calcium bicarbonate. Calcium carbonate has been unexpectedly found to be non-corrosive to metals and compatible to elastomers and seals. Calcium carbonate is also water insoluble. Calcium bicarbonate, however, has an acidic proton which at high temperatures can corrosively attack metal surfaces such as found in the caster bearings of hot steel slab casters. Also, calcium bicarbonate has been found to corrode, crack, and/or degrade many elastomers and seals. Calcium bicarbonate has also been undesirably found to be water soluble and experiences many of the same problems as monocalcium phosphate and dicalcium phosphate discussed above. Also, calcium bicarbonate is disadvantageous for another reason. During normal use, either the base oil or antioxidant additives will undergo a certain amount of oxidation. The end products of this oxidation are invariably acidic. These acid oxidation products can react with calcium bicarbonate to undesirably produce gaseous carbon dioxide. If the grease is used in a moderately sealed application such as slab caster bearings, the calcium carbonate generated would build up pressure and eventually weaken the seal in order to escape. Once weakened, the seal would be much less effective in minimizing water contamination of the bearing.

The use of both tricalcium phosphate and calcium carbonate together in the extreme pressure antiwear (wear-resistant) additive package of the steel mill grease was found to produce unexpected superior results.

BORATES

It was found that borates or boron-containing materials such as borated amine, when used in polyurea greases in the presence of calcium phosphates and calcium carbonates, act as an oil separation inhibitor, which is especially useful at high temperatures, such as occurs in slab casting and other operations in steel mills. This discovery is also highly advantageous since oil separation, or bleed, as to which it is sometimes referred, is a property which needs to be minimized in steel mill greases.

Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company.

Other useful borates include borates of Group 1a alkali metals, borates of Group 2a alkaline earth metals, stable borates of transition metals (elements), such as zinc, copper, and tin, boric oxide, and combinations of the above.

The steel mill grease contains 0.01% to 10%, preferably 0.1% to 5%, and most preferably 0.25% to 2.5%, by weight borated material.

It was also found that borated inhibitors minimized oil separation even when temperatures were increased from 210° F. to 300° F. or 350° F. Advantageously, borated inhibitors restrict oil separation over a wide temperature range. This is in direct contrast to the traditional oil separation inhibitors, such as high molecular weight polymer inhibitors such as that sold under the brand name of Paratac by Exxon Chemical Company U.S.A. Traditional polymeric additives often impart an undesirable stringy or tacky texture to the lubricating grease because of the extremely high viscosity and long length of their molecules. As the temperature of the grease is raised, the viscosity of the polymeric additive within the grease is substantially reduced as is its tackiness. Tackiness restricts oil bleed. As the tackiness is reduced, the beneficial effect on oil separation is also reduced. Borated amine additives do not suffer from this flaw since their effectiveness does not depend on imparted tackiness. Borated amines do not cause the lubricating grease to become tacky and stringy. This is desirable since, in many applications of lubricating greases, oil bleed should be minimized while avoiding any tacky or stringy texture.

It is believed that borated amines chemically interact with the tricalcium phosphate and/or calcium carbonate in the grease. The resulting species then interacts with the polyurea thickener system in the grease to form an intricate, complex system which effectively binds the lubricating oil.

Another benefit of borated oil separation inhibitors and additives over conventional "tackifier" oil separation additives is their substantially complete shear stability. Conventional tackifier additives comprise high molecular weight polymers with very long molecules. Under conditions of shear used to physically process and mill lubricating greases, these long molecules are highly prone to being broken into much smaller fragments. The resulting fragmentary molecules are greatly reduced in their ability to restrict oil separation. To avoid this problem, when conventional tackifiers are used to restrict oil separation in lubricating greases, they are usually mixed into the grease after the grease has been milled. This requires an additional processing step in the lubricating grease manufacturing procedure. Advantageously, borated amines and other borated additives can be added to the base grease with the other additives, before milling, and their properties are not adversely affected by different types of milling operations.

In contrast to conventional tackifiers, borated amines can be pumped at ordinary ambient temperature into manufacturing kettles from barrels or bulk storage tanks without preheating.

Inorganic borate salts, such as potassium triborate, provide an oil separation inhibiting effect similar to borated amines when used in polyurea greases in which calcium phosphate and calcium carbonate are also present. It is believed that the physio-chemical reason for this oil separation inhibiting effect is similar to that for borated amines. The advantages of borated amines over conventional tackifier additives are also applicable in the case of inorganic borate salts.

POLYMERS

It has been unexpectedly and surprisingly found that the polymeric additives comprising the polymers described below, in the absence of sulfur and particularly in the absence of organically bonded sulfur, when used in the presence of and in combination and conjunction with the above described tricalcium phosphate and calcium carbonate extreme pressure wear-resistant additives and preferably with the above described boron-containing material, imparts requisite adhesive strength and water resistance properties to the finished grease to substantially prevent the grease from running, bleeding, and being washed (flushed) out of caster bearings and caster rollers of hot slab casters in steel mills when the hot steel slab is substantially continuously quenched with high velocity, high pressure water sprays. The polymers are thermally stable and substantially minimize high temperature oxidation, corrosion, thermal breakdown, detrimental polymerization of the grease, and lacquering (lacquer deposition) of tapered roller bearing (caster bearings) in steel mills and process mills from the heat, load, and stress of the hot steel slabs. Advantageously, such polymers are hydrophobic and also extend the useful life of the grease and decrease overall grease consumption in steel and process mills. Polymers containing organically bonded sulfur should be avoided due to their high temperature corrosive nature.

It has also been unexpectedly found that the preferred and most preferred polymers described below, when used in the presence of and in combination and conjunction with the described tricalcium phosphate and calcium carbonate extreme pressure wear-resistant additives and preferably the described boron-containing material, do not adversely affect the low temperature mobility and pumpability properties of the finished steel mill grease. This is most surprising since polymers generally will cause large adverse effects on the low temperature flow properties of greases. Low temperature properties are important for steel mills since bulk grease storage tanks at steel mills are often outside and exposed to winter temperatures.

Polymers which are applicable for use in steel mill greases to attain the desired characteristics described above desirably have molecular weights in the range from about 1,000 to about 5,000,000 or more. Preferably, the polymer molecular weight should be between 10,000 and 1,000,000. For best results the polymer molecular weight should be between 50,000 and 200,000.

Acceptable polymers for attaining many of the grease characteristics described above include: polyolesters (polyesters), polyamides, polyurethanes, polyoxides, polyamines, polyacrylamide, polyvinyl alcohol, ethylene vinyl acetate, and polyvinyl pyrrolidone. Copolymers with monomeric units comprising the monomeric units of the preceding polymers and combinations thereof may also be used. Also, boronated polymers or boronated compounds comprising the borated or boronated analogs of the preceding polymers (i.e., any of the preceding polymers reacted with boric acid, boric oxides, or boron inorganic oxygenated material) may also be used when nucleophilic sites are available for boration.

For better results, the preferred polymer comprises: polyolefins (polyalkylenes), such as polyethylene, polypropylene, polyisobutylene, ethylene propylene copolymers, or ethylene butylene copolymers; or polyolefin (polyalkylene) arylene copolymers, such as ethylene styrene copolymers and styrene isoprene copolymers. Polyarylene polymers, such as polystyrene, also provide good results.

Most preferably for best results, the polymer should be a methacrylate polymer or copolymer. Particularly useful polymethacrylate polymers are those sold under the trade name TC 9355 by Texaco Chemical Company as well as those sold under the trade name HF-420 by Rohm and Haas Company.

GREASE FLAMMABILITY

Grease properties (performance factors) which tend to lessen the occurrence of grease fires in steel mills include the following:

1. Reduction in the amount of grease used per unit time, i.e., decrease in grease consumption.
2. Reduction in the amount of grease which leaks past the bearing seals and out of the bearing housings.
3. Ignition resistance.

The importance of the above performance factors is explained as follows. If less grease is used over a given time interval, less grease will be exposed to direct contact of ignition sources. If the amount of grease leaking out of the sealed bearings is reduced, this will also reduce the fire potential. Furthermore, if a grease has intrinsic resistance to ignition, it is less likely to fuel grease fires.

It was unexpectedly and surprisingly found that the described novel steel mill grease does have all three of the above mentioned properties. The novel grease desirably has a significant level of resistance to ignition by direct flame contact.

It is believed the above ignition resistance properties are attributable to the thermal decomposition of calcium carbonate in the grease to produce carbon dioxide. When the flame contacts the grease surface, carbon dioxide can form, dropping the local oxygen level below the 15% required to sustain combustion. This in turn causes the flame to be blanketed and smothered with carbon dioxide.

The process for preventing grease fires is especially useful in steel mills and other metal processing mills, such as strip mills, billet mills, plate mills, and rod mills. In the process, when a flame is ignited, such as from molten steel or other hot metal, or from acetylene torches or other welding equipment, and approaches near the described special grease, which can be injected into the caster bearings or rollers in a metal processing mill, the special grease emits a sufficient amount of carbon dioxide to blanket and extinguish the flame or otherwise substantially prevent the grease from igniting, burning, and combusting. In the preferred process, carbon dioxide is emitted from thermal decomposition of calcium carbonate in the grease.

The ignition resistance of the grease of this invention was tested in a laboratory and in a large midwestern steel mill, as discussed hereinafter in Examples 48–58.

METAL WORKING PROCESS

In the metal working process, steel, iron, or other metal is cast, formed, treated, fabricated, worked, or otherwise processed in a steel mill or a process mill, such as a hot strip mill, cold strip mill, billet mill, plate mill, or rod mill, and conveyed on caster rollers with bearings. In the process, the described special high performance grease is injected, fed, and placed into the bearings and prevented from leaking out of the bearings so as to lubricate and enhance the longevity and useful life of the bearings. Desirably, the bearings are protected against rust and corrosion at high temperatures during casting, working, and fabricating, as well as at ambient and lower temperatures. Preferably, this is accomplished by the described special non-corrosive, oxidatively stable, thermally stable, adhesive-imparting grease which also hermetically seals the bearings, substantially eliminates grease leakage, prevents toxic emissions, and does not normally irritate the skin or eyes of workers in the mill. Advantageously, substantially less grease is required, consumed, and used with the described special grease.

During casting in steel mills, molten steel is fed to a formation chamber where it is cast and formed into a hot steel slab and discharged onto a slab caster. The hot steel slab is conveyed on caster rollers with tapered rollers bearings. The hot steel slab is quenched and cooled with a high velocity water spray from above and below the caster rollers and bearings. Advantageously, the special high performance grease prevents the grease from being flushed and washed out of the bearings.

The following Examples are for purposes of illustration and not for purposes of limiting the scope of the invention as provided in the appended claims.

EXAMPLE 1

Polyurea thickener was prepared in a pot by adding: (a) about 30% by weight of a solvent extracted neutral base oil containing less than 0.1% by weight sulfur with a viscosity of 600 SUS at 100° F. and (b) about 7.45% by weight of primary oleyl amine. The primary amine base oil was then mixed for 30–60 minutes at a maximum temperature of 120° F. with about 5.4% by weight of an isocyanate, such as 143 L-MDI manufactured by Upjohn Company. About 3% by weight water was then added and stirred for about 20 to 30 minutes, before removing excess free isocyanates and amines.

The polyurea thickener can also be prepared, if desired, by reacting an amine and a diamine with diisocyanate in the absence of water. For example, polyurea can be prepared by reacting the following components:

1. A diisocyanate or mixture of diisocyanates having the formula OCN-R-NCO, wherein R is a hydrocarbylene having from 2 to 30 carbons, preferably from 6 to 15 carbons, and most preferably 7 carbons;
2. A polyamine or mixture of polyamines having a total of 2 to 40 carbons and having the formula:

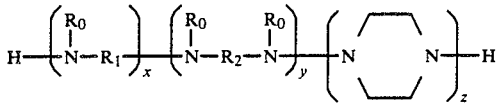

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1–C4 alkyl, and preferably hydrogen; x is an integer from 0 to 4; y is 0 or 1; and z is an integer equal to 0 when y is 1 and equal to 1 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The molar ratio of the reactants present can vary from 0.1–2 molar parts of monoamine or monoisocyanate and 0–2 molar parts of polyamine for each molar part of diisocyanate. When the monoamine is employed, the molar quantities can be $(m+1)$ molar parts of diisocyanate, (m) molar parts of polyamine and 2 molar parts of monoamine. When the monoisocyanate is employed, the molar quantities can be (m) molar parts of diisocyanate, $(m+1)$ molar parts of polyamine and 2 molar parts of monoisocyanate (m is a number from 0.1 to 10, preferably 0.2 to 3, and most preferably 1).

Mono- or polyurea compounds can have structures defined by the following general formula:

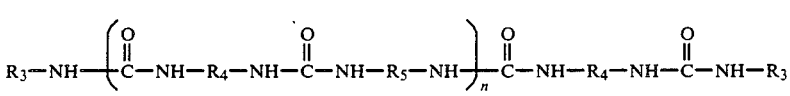

(1)

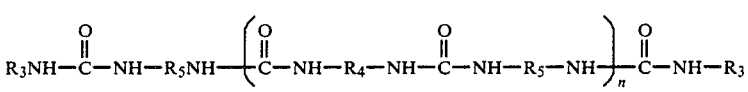

(2)

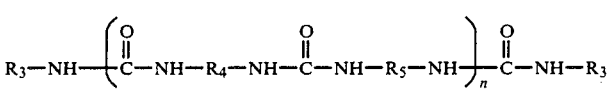

(3)

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturated (one or more double-bonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula 1 above are prepared by reacting $(n+1)$ molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with $(n+1)$ molar parts of a diamine and 2 molar parts of a monoisocyanate. (When n equals zero in the above Formula 2, the diisocyanate is deleted). Mono- or polyureas having the structure presented in Formula 3 above are prepared by reacting (n) molar parts of a diisocyanate with (n) molar parts of a diamine and 1 molar part of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst reactants under conditions conducive for the reaction. Typical reaction temperatures range from 70° F. to 210° F. at atmospheric pressure. The reaction itself is exothermic and, by initiating the reaction at room temperature, elevated temperatures are obtained. External heating or cooling may be used.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadeccadienylamine, abietylamine, aniline, toluidine, naphthylamine, cumylamine, bornylamine, fenchylamine, tertiary butyl aniline, benzylamine, beta-phenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc.

Unsaturated amines are particularly useful. Illustrative of monoisocyanates are: hexylisocyanate, decylisocyanate, dodecylisocyante, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

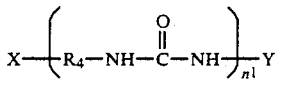

wherein $n^1$ is an integer of 1 to 3, $R_4$ is defined supra; X and Y re monovalent radicals selected from Table 1 below:

TABLE I

| X | Y |
|---|---|
| $R_7-C(=O)-NH-$ | $R_7-C(=O)-NH-R_5-$ |
| 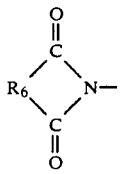 | 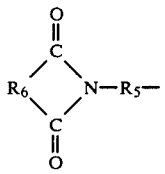 |
| | $R_8-$ |

In Table 1, $R_5$ is defined supra, $R_8$ is the same as $R_3$ and defined supra, $R_6$ is selected from the groups consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2) above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

EXAMPLE 2

This test served as the control for subsequent tests. A base grease was formulated with about 15% by weight polyurea thickener and about 85% by weight paraffinic solvent extracted base oil. The polyurea thickener was prepared in a vessel in a manner similar to Example 1. The paraffinic solvent extracted base oil was mixed with the polyurea thickener until a homogeneous base grease was obtained. No additive package was added to the base grease. Neither tricalcium phosphate nor calcium carbonate were present in the base grease. The EP (extreme pressure)/antiwear properties of the base grease, comprising the last nonseizure load, weld load, and load wear index were measured using the Four Ball EP method as described in ASTM D2596. The results were as follows:

| | |
|---|---|
| Last nonseizure load, kg | 32 |
| Weld load, kg | 100 |
| Load wear index | 16.8 |

EXAMPLE 3

A grease was prepared in a manner similar to Example 2, except that about 5% by weight of finely divided, precipitated tricalcium phosphate with an average mean diameter of less than 2 microns was added to the base grease. The resultant mixture was mixed and milled in a roll mill until a homogeneous grease was produced. The Four Ball EP Test showed that the EP/antiwear properties of the grease were significantly increased with tricalcium phosphate.

| | |
|---|---|
| Last nonseizure load, kg | 63 |
| Weld load, kg | 160 |
| Load wear index | 33.1 |

EXAMPLE 4

A grease was prepared in a manner similar to Example 3, except that about 10% by weight tricalcium phosphate was added to the base grease. The Four Ball EP Test showed that the EP/antiwear properties were further increased with more tricalcium phosphate.

| | |
|---|---|
| Last nonseizure load, kg | 80 |

-continued

| | |
|---|---|
| Weld load, kg | 250 |
| Load wear index | 44.4 |

EXAMPLE 5

A grease was prepared in a manner similar to Example 4, except that about 20% by weight tricalcium phosphate was added to the base grease. The Four Ball EP Test showed that the EP/antiwear properties of the grease were somewhat better than the 5% tricalcium phosphate grease of Example 3, but not as good as the 10% tricalcium phosphate grease of Example 4.

| | |
|---|---|
| Last nonseizure load, kg | 63 |
| Weld load, kg | 250 |
| Load wear index | 36.8 |

EXAMPLE 6

A grease was prepared in a manner similar to Example 2, except that about 5% by weight of finely divided precipitated tricalcium phosphate and about 5% by weight of finely divided calcium carbonate were added to the base grease. The tricalcium phosphate and calcium carbonate had an average mean particle diameter less than 2 microns. The resultant grease was mixed and milled until it was homogeneous. The Four Ball EP Test showed that the EP/antiwear properties of the grease were surprisingly better than the base grease of Example 1 and the tricalcium phosphate greases of Examples 2–5.

| | |
|---|---|
| Last nonseizure load, kg | 80 |
| Weld load, kg | 400 |
| Load wear index | 52.9 |

EXAMPLE 7

A grease was prepared in a manner similar to Example 6, except that 10% by weight tricalcium phosphate and 10% by weight calcium carbonate were added to the base grease. The Four Ball EP Test showed that the weld load was slightly lower and the load wear index were slightly better than the grease of Example 6.

| | |
|---|---|
| Last nonseizure load, kg | 80 |
| Weld load, kg | 315 |
| Load wear index | 55.7 |

EXAMPLE 8

A grease was prepared in a manner similar to Example 7, except that 20% by weight tricalcium phosphate and 20% calcium carbonate were blended into the base grease. The Four Ball EP Test showed that the EP/antiwear properties of the grease were better than greases of Examples 6 and 7.

| | |
|---|---|
| Last nonseizure load, kg | 100 |
| Weld load, kg | 500 |
| Load wear index | 85.6 |

EXAMPLE 9

A grease was prepared in a manner similar to Example 2, except that about 10% by weight of finely divided calcium carbonate with a mean particle diameter less than 2 microns, was added to the base grease. The resultant grease was mixed and milled until it was homogeneous. The Four Ball EP Test showed that the weld load and load wear index of the calcium carbonate grease were better than the base grease of Example 2.

| | |
|---|---|
| Last nonseizure load, kg | 80 |
| Weld load, kg | 400 |
| Load wear index | 57 |

EXAMPLE 10

A grease was prepared in a manner similar to Example 6, except that about 3% by weight tricalcium phosphate and about 5% by weight calcium carbonate were added to the base grease. The Four Ball EP Test showed that the weld load and load wear index of the grease were better than the greases of Example 4 (10% tricalcium phosphate alone) and Example 9 (10% calcium carbonate alone), even though the total combined level of additives was only 8%. This result is most surprising and unexpected. It illustrates how the two additives can work together to give the surprising improvements and beneficial results.

| | |
|---|---|
| Last nonseizure load, kg | 80 |
| Weld load, kg | 500 |
| Load wear index | 61.8 |

EXAMPLE 11

The grease of Example 6 (5% by weight tricalcium phosphate and 5% by weight calcium carbonate) was subjected to the ASTM D4048 Copper Corrosion Test at a temperature of 300° F. for 24 hours. No significant corrosion appeared. The copper test sample remained bright and shiny. The copper strip was rated 1a.

EXAMPLE 12

The grease of Example 10 (3% by weight tricalcium phosphate and about 5% by weight calcium carbonate) was subjected to the ASTM D4048 Copper Corrosion Test at a temperature of 300° F. for 24 hours. The results were similar to Example 11.

EXAMPLE 13

A grease was prepared in a manner similar to Example 6, except that about 3.5% by weight tricalcium phosphate, about 3.5% by weight calcium carbonate, and about 7% by weight of an insoluble arylene sulfide polymer, manufactured by Phillips Petroleum Company under the trade name RYTON, were added to the base grease. The grease containing insoluble arylene sulfide polymer was subjected to the ASTM D4048 Copper Corrosion Test at a temperature of 300° F. for 24 hours and failed miserably. Significant corrosion appeared. The copper test strip was spotted and colored and was rated 3b.

EXAMPLE 14

A grease was prepared in a manner similar to Example 3, except as follows. The base oil comprised about 60% by weight of 850 SUS paraffinic, solvent extracted, hydrogenated mineral oil, and about 40% by weight of 350 SUS paraffinic, solvent extracted, hydrogenated mineral oil. The base grease comprised 16.07% polyurea thickener. Instead of adding tricalcium phosphate, 11.13 and dicalcium phosphate, sold under the brand name of Biofos by IMC, were added to the base grease. The resultant grease was milled in a manner similar to Example 2 and subjected to an Optimol SRV stepload test (described in Example 19). The test grease failed. The coefficient of friction slipped and was highly erratic, indicating rapid wear. The scar on the disk was rough and showed a lot of wear.

EXAMPLE 15

The grease of Example 13 containing oil-insoluble arylene polymers was subjected to the ASTM D4170 Fretting Wear Test and an Elastomer Compatibility Test for Silicone at 150° C. for 312 hours. The results were as follows

| | |
|---|---|
| Fretting Wear, ASTM D4170, 72 hr mg loss/race set | 5.6 |
| Elastomer Compatibility with Silicone | |
| % loss tensile strength | 17.4 |
| % loss total elongation | 16.9 |

EXAMPLE 16

The grease of Example 6 was subjected to the ASTM D4170 Fretting Wear Test and an Elastomer Compatibility Test for Silicone at 150° C. for 312 hours. The grease displayed substantially better fretting resistance and elastomer compatibility than the grease of Example 15 containing insoluble arylene polymers.

| | |
|---|---|
| Fretting Wear, ASTM D4170, 72 hr mg loss/race set | 3.0 |
| Elastomer Compatibility with Silicone | |
| % loss tensile strength | 9.9 |
| % loss total elongation | 12.2 |

EXAMPLE 17

A grease was prepared in a manner similar to Example 6, except as described below. The polyurea thickener was prepared in a manner similar to Example 1 by reacting 676.28 grams of a fatty amine, sold under the brand name Armeen T by Armak Industries Chemicals Division, 594.92 grams of a diisocyanate, sold under the brand name Mondur CD by Mobay Chemical Corporation, and 536 ml of water. The base oil had a viscosity of 650 SUS at 100° F. and was a mixture of 850 SUS paraffinic, solvent extracted, hydrogenated mineral oil, and hydrogenated solvent extracted, dewaxed, mineral oil. Corrosive inhibiting agents, sold under the brand names of Nasul BSN by R. T. Vanderbilt Co. and Lubrizol 5391 by the Lubrizol Corp., were added to the grease for ferrous corrosion protection. The anti-oxidants were a mixture of arylamines. The grease was stirred and subsequently milled through a Gaulin Homogenizer at a pressure of 7000 psi until a homogeneous grease was produced. The grease had the following composition:

| Component | % (wt) |
|---|---|
| 850 SUS Oil | 47.58 |
| 350 SUS Oil | 31.20 |
| Polyurea Thickener | 9.50 |
| Tricalcium Phosphate | 5.00 |
| Calcium Carbonate | 5.00 |
| Nasul BSN | 1.00 |
| Lubrizol 5391 | 0.50 |
| Mixed Aryl Amines | 0.20 |
| Dye | 0.02 |

The grease was tested and had the following performance properties:

| | |
|---|---|
| Worked Penetration, ASTM D217 | 307 |
| Dropping Point, ASTM D2265 | 501° F. |
| Four Ball Wear, ASTM D2266 at 40 kg, 1200 rpm for 1 hr | 0.50 |
| Four Ball EP, ASTM D2596 | |
| last nonseizure load, kg | 80 |
| weld load, kg | 400 |
| load wear index | 57 |
| Timken, ASTM D4170, lbs | 60 |
| Fretting Wear, ASTM D4170, 24 hr mg loss/race set | 0.8 |
| Corrosion Prevention Test, ASTM D1743 | 1 |
| Elastomer Compatibility with Polyester | |
| % loss tensile strength | 21.8 |
| % loss maximum elongation | 12.9 |
| Elastomer Compatibility with Silicone | |
| % loss tensile strength | 7.4 |
| % loss maximum elongation | 24.2 |

EXAMPLE 18

The grease of Example 17 was subjected to an oil separation cone test (bleed test), SDM 433 standard test of the Saginaw Steering Gear Division of General Motors. In the test, the grease was placed on a 60 mesh nickel screen cone. The cone was heated in an oven for the indicated time at the listed temperature. The percentage decrease in the weight of the grease was measured. The test showed that minimum oil loss occurred even at higher temperatures over a 24-hour time period. The results were as follows:

| time (hr) | temp (°F.) | % oil loss |
|---|---|---|
| 6 | 212 | 1.9 |
| 24 | 212 | 4.4 |
| 24 | 300 | 2.1 |
| 24 | 350 | 3.4 |

EXAMPLE 19

The grease of Example 17 was subjected to an Optimol SRV stepload test under conditions recommended by Optimol Lubricants, Inc. and used by Automotive Manufacturers such as General Motors for lubricant evaluation. This method was also specified by the U.S. Air Force Laboratories Test Procedure of Mar. 6, 1985. In the test, a 10 mm steel ball is oscillated under load increments of 100 newtons on a lapped steel disc lubricated with the grease being tested until seizure occurs. The grease passed the maximum load of 900 newtons.

EXAMPLES 20–21

Two greases were prepared from a polyurea base grease in a manner similar to Example 17. Test grease 20 was prepared without a borate additive In test grease 21, a borated amine was added, and the resultant mixture was mixed and subsequently milled until a homogeneous grease was produced. Test grease 21 with the borated amine decreased oil separation over test grease 20 by over 31% to 45% at 212° F., by over 50% at 300° F., and by over 51% at 350° F.

| Test Grease | 20 | 21 |
|---|---|---|
| Base Oil Viscosity; ASTM D445 SUS at 100° F. | 600 | 600 |
| % Thickener (polyurea) | 9.6 | 9.6 |
| % Tricalcium Phosphate | 5.0 | 5.0 |
| % Calcium Carbonate | 5.0 | 5.0 |
| % Borated Amine (Lubrizol 5391) | 0 | 0.5 |
| Worked Penetration, ASTM D217 | 300 | 297 |
| Dropping Point, ASTM D2265, °F. | 490 | 494 |
| Oil Separations, SDM 433, % | | |
| 6 hr, 212° F. | 4.17 | 2.27 |
| 24 hr, 212° F. | 5.53 | 3.77 |
| 24 hr, 300° F. | 8.03 | 4.01 |
| 24 hr, 350° F. | 12.18 | 5.85 |

EXAMPLES 22–23

Test grease 22 and 23 were prepared in a manner similar to Examples 20 and 21, except greases 22 and 23 were formulated about 14 points of penetration softer. Test grease 23 with the borated amine decreased oil separation over test grease 22 without borated amine by over 31% to 38% at 212° F., by over 18% at 300° F., and by over 48% at 350° F.

| Test Grease | 22 | 23 |
|---|---|---|
| Base Oil Viscosity, ASTM D445 SUS at 100° F. | 600 | 600 |
| % Thickener (polyurea) | 9.6 | 9.6 |
| % Tricalcium Phosphate | 5.0 | 5.0 |
| % Calcium Carbonate | 5.0 | 5.0 |
| % Borated Amine (Lubrizol 5391) | 0 | 0.5 |
| Worked Penetration, ASTM D217 | 312 | 315 |
| Dropping Point, ASTM D2265, °F. | 491 | 497 |
| Oil Separations, SDM 433, % | | |
| 6 hr, 212° F. | 5.45 | 3.34 |
| 24 hr, 212° F. | 8.71 | 5.97 |
| 24 hr, 300° F. | 9.71 | 7.88 |
| 24 hr, 350° F. | 15.71 | 8.06 |

EXAMPLES 24–26

Three greases were made from a common polyurea base. The base oil viscosity was reduced from the previous value of 600 SUS at 100° F. to a new value of 100 SUS at 100° F. The worked penetrations of the three greases were also substantially softened from earlier values. Both of these changes tend to increase oil separation values. Except for these changes, all three greases were prepared in a manner similar to Examples 20–23. Test grease 24 was prepared without a borated amine. Test grease 25 contained 0.5% by weight borated amine. Test grease 26 contained 1% by weight of a conventional tackifier oil separation inhibitor (Paratac). To prevent the conventional tackifier oil separation additive from shearing down, it was added to the grease after the milling was complete. The superior performance of the borated amine additive over the conventional tackifier oil separation additive is apparent. Test grease 25 containing borated amine decreased oil separation over test grease 26 containing a conventional tackifier oil separation additive by over 38% at 150° F., by 40% at 212° F., and by over 44% at 300° F. Test grease 25 containing borated amine decreased oil separation over test grease 24 without any oil separation additive by 50% at 150° F., by over 42% at 212° F. and at 300° F., and by over 12% at 350° F. The Paratac gives some benefit at 150° F., but this benefit vanishes as the test temperature increases.

| Test Grease | 24 | 25 | 26 |
|---|---|---|---|
| Base Oil Viscosity, ASTM D445 SUS at 100° F. | 600 | 600 | 600 |
| % Thickener (polyurea) | 6.0 | 6.0 | 6.0 |
| % Tricalcium Phosphate | 5.0 | 5.0 | 5.0 |
| % Calcium Carbonate | 5.0 | 5.0 | 5.0 |
| % Borated Amine (Lubrizol 5391) | 0 | 0.5 | 0 |
| % Conventional Tackifier Oil Separation Additive (Paratac) | 0 | 0 | 1.0 |
| Worked Penetration, ASTM D217 | 383 | 384 | 359 |
| Oil Separations, SDM 433, % | | | |
| 24 hr, 150° F. | 9.6 | 4.8 | 7.8 |
| 24 hr, 212° F. | 12.1 | 6.9 | 11.5 |
| 24 hr, 300° F. | 9.7 | 5.6 | 10.1 |
| 24 hr, 350° F. | 34.3 | 30.0 | 30.6 |

Inorganic borate salts, such as potassium triborate, provide an oil separation inhibiting effect similar to borated amines when used in polyurea greases in which calcium phosphate and calcium carbonate are also present. It is believed that the physio-chemical reason for this oil separation inhibiting effect is similar to that for borated amines. This discovery is particularly surprising since inorganic borate salts had not been used as oil separation inhibitors. The advantages of borated amines over conventional tackifier additives are also applicable in the case of inorganic borate salts.

EXAMPLES 27–29

Test grease 27 was prepared in a manner similar to Example 17 but without any tricalcium phosphate, calcium carbonate, or a borate additive. A 2% potassium triborate was added to test grease 27 prior to mixing and milling. Test grease 28 was prepared in a manner similar to Example 27 but with 5% tricalcium phosphate, 5% calcium carbonate, and 0.5% borated amine. Test grease 28 did not contain potassium triborate. Test grease 29 was prepared by mixing equal weights of unmilled test greases 27 and 28 until a homogeneous mixture was attained. The resultant mixture was subsequently milled under conditions similar to Examples 27 and 28. The borated amine test grease 28 produced superior results over test grease 27, which contained no tricalcium phosphate or calcium carbonate. Test grease 29 was prepared in a manner similar to Example 28 but with 2.5% tricalcium phosphate, 2.5% calcium carbonate, 0.25% borated amine, and 1% potassium triborate. The borated test grease 28 decreased oil separation over test grease 27 by over 35% to 44% at 212° F., by over 55% at 300° F., and by over 38% at 350° F. Test grease 29 contained about one-half of the borated amine of test grease 28 but also contained about 1% by weight potassium triborate (OLOA 9750). The borated amine, potassium triborate, test grease 29 produced even better results than either test grease 27 or test grease 28. The borated amine, potassium triborate, test grease 29 dramatically reduced oil separation over test grease 28 by 13% to over 15% at 212° F., by over 20% at 300° F., and by over 38% at 350° F. Even though test grease 27 also contained about 2% by weight potassium triborate (OLOA 9750), similar to test grease 29, test grease 27 did not contain tricalcium phosphate or calcium carbonate. Test grease 29 decreased oil separation over test grease 27 by over 45% to 50% at 212° F., by over 64% at 300° F., and by over 62% at 350° F.

| Test Grease | 27 | 28 | 29 |
|---|---|---|---|
| Base Oil Viscosity, SUS at 100° F. | 600 | 600 | 600 |
| % Tricalcium Phosphate | 0 | 5.0 | 2.5 |
| % Calcium Carbonate | 0 | 5.0 | 2.5 |
| % Borated Amine (Lubrizol 5391) | 0.0 | 0.5 | 0.25 |
| % Potassium Triborate (OLOA 9750) | 2.0 | 0.0 | 1.0 |
| Worked Penetration | 310 | 295 | 300 |
| Dropping Point, °F. | 533 | 506 | 489 |
| Oil Separation, SDM 433, % | | | |
| 6 hr, 212° F. | 5.2 | 3.0 | 2.6 |
| 24 hr, 212° F. | 9.9 | 6.4 | 5.4 |
| 24 hr, 300° F. | 8.9 | 4.0 | 3.2 |
| 24 hr, 350° F. | 10.0 | 6.2 | 3.8 |

EXAMPLES 30–33

A grease was made in a manner similar to that of Example 17. However, additives were used such that the final compositions was as follows:

| Component | % (wt) |
|---|---|
| 850 SUS Oil | 45.88 |
| 350 SUS Oil | 30.35 |
| Polyurea Thickener | 10.00 |
| Tricalcium Phosphate | 5.56 |
| Calcium Carbonate | 5.56 |
| Nasul BSN | 2.22 |
| Lubrizol 5391 | 0.56 |
| Mixed Aryl Amines | 0.22 |

Four portions of this grease were placed into separate vessels. To the first was added 850 SUS Oil and 350 SUS Oil only. This grease served as the control for comparison of the other three greases in Examples 31–33. To the second portion was added 850 SUS Oil and 350 Oil and polymethacrylate sold by Texaco Chemical Company under the trade name of TC 9355. To the third portion was added 850 SUS Oil, 350 SUS Oil, and an ethylene-propylene copolymer sold by Functional Products, Inc. under the trade name Functional V-157Q. To the fourth portion was added 850 SUS Oil, 350 SUS Oil, and Paratac. The four greases were heated and stirred to homogeneously mix the oil and polymers into the grease. Then each grease was given one pass through a Gaulin homogenizer at 7,000 psi. The resulting final test greases were evaluated to determine the effect of the various polymers on low temperature properties. Compositions and test results are given below:

| Test Grease | Ex. 30 | Ex. 31 | Ex. 32 | Ex. 33 |
|---|---|---|---|---|
| Component, % (wt) | | | | |
| 850 SUS Oil | 46.98 | 44.58 | 45.78 | 44.58 |
| 350 SUS Oil | 31.32 | 29.72 | 30.52 | 29.72 |
| Polyurea Thickener | 9.00 | 9.00 | 9.00 | 9.00 |
| Tricalcium Phosphate | 5.00 | 5.00 | 5.00 | 5.00 |
| Calcium Carbonate | 5.00 | 5.00 | 5.00 | 5.00 |
| Nasul BSN | 2.00 | 2.00 | 2.00 | 2.00 |
| Lubrizol 5391 | 0.50 | 0.50 | 0.50 | 0.50 |

-continued

| Test Grease | Ex. 30 | Ex. 31 | Ex. 32 | Ex. 33 |
|---|---|---|---|---|
| Mixed Aryl Amines | 0.20 | 0.20 | 0.20 | 0.20 |
| TC 9355 | 0 | 4.00 | 0 | 0 |
| Functional V-157Q | 0 | 0 | 2.00 | 0 |
| Paratac | 0 | 0 | 0 | 4.00 |
| Test Results | | | | |
| Worked Penetration | 372 | 384 | 400 | 370 |
| Dropping Point, °F. | 533 | 530 | 532 | 533 |
| Low Temperature Torque at −10° F., ASTM D1478 | | | | |
| Starting, g-cm | 3,245 | 2,065 | 6,343 | 1,623 |
| Running, g-cm | 738 | 295 | 443 | 443 |
| Low Temperature Torque at −20° F., ASTM D1478 | | | | |
| Starting, g-cm | 6,343 | 4,425 | 11,948 | 5,310 |
| Running, g-cm | 531 | 738 | 1,269 | 738 |

The grease of Example 31 which contained the polymethacrylate polymer TC9355 gave the least increased torques when compared to the control grease of Example 30. In fact, at −10° F., both starting and running torques of Example 31 were less than that of Example 30. Example 31 was the only polymer containing test grease of this set which had that property. Of Examples 31–33, Example 31 had the best overall low temperature properties as measured by low temperature torque. The grease of Example 33 which contained the Paratac was the second best in low temperature properties. However, Example 33 had very little adhesive character when compared with the control grease of Example 33. This was due to the very high shear sensitivity of the high molecular weight polyisobutylene polymer Paratac. The test grease of Example 32 had the largest increase in low temperature torque when compared to the control grease of Example 30. The test greases of Examples 31 and 32 had a significantly increased adhesive character when compared to the test grease of Example 30.

EXAMPLES 34–37

Four samples similar to the samples of Examples 30–33 were prepared using a method similar to that described in Examples 30–33. However, the final thickener level was increased to 10% so as to increase the grease hardness. Also, 2% of potassium triborate (OLOA 9750) was added to assist in reduction of oil separation. Compositions and test results ar given below.

| Test Grease | Ex. 34 | Ex. 35 | Ex. 36 | Ex. 37 |
|---|---|---|---|---|
| Component, % (wt) | | | | |
| 850 SUS Oil | 45.18 | 42.78 | 43.98 | 42.78 |
| 350 SUS Oil | 30.12 | 28.52 | 29.32 | 28.52 |
| Polyurea Thickener | 10.00 | 10.00 | 10.00 | 10.00 |
| Tricalcium Phosphate | 5.00 | 5.00 | 5.00 | 5.00 |
| Calcium Carbonate | 5.00 | 5.00 | 5.00 | 5.00 |
| Nasul BSN | 2.00 | 2.00 | 2.00 | 2.00 |
| OLOA 9750 | 2.00 | 2.00 | 2.00 | 2.00 |
| Lubrizol 5391 | 0.50 | 0.50 | 0.50 | 0.50 |
| Mixed Aryl Amines | 0.20 | 0.20 | 0.20 | 0.20 |
| TC 9355 | 0 | 4.00 | 0 | 0 |
| Functional V-157Q | 0 | 0 | 2.00 | 0 |
| Paratac | 0 | 0 | 0 | 4.00 |
| Test Results | | | | |
| Worked Penetration | 369 | 329 | 369 | 325 |
| Dropping Point, °F. | 538 | 534 | 507 | 535 |
| Oil Separation, SDM 433, % | | | | |
| 24 hr, 212° F. | 6.0 | 6.0 | 6.3 | 4.1 |
| 24 hr, 300° F. | 5.5 | 8.9 | 8.9 | 4.5 |
| 24 hr, 350° F. | 6.5 | 9.8 | 10.8 | 6.2 |

-continued

| Test Grease | Ex. 34 | Ex. 35 | Ex. 36 | Ex. 37 |
|---|---|---|---|---|
| Four Ball Wear, ASTM D2266, mm | 0.44 | 0.44 | 0.44 | 0.44 |
| Four Ball EP, ASTM D2596 | | | | |
| Weld Load, Kg | 400 | 400 | 400 | 400 |
| Load Wear Index | 48.1 | 48.4 | 44.3 | 48.7 |
| Optimol SRV Stepload Test, Newtons | 900 | 900 | 900 | 900 |
| Water Washout, ASTM D1264 at 170° F., % loss | 0 | 0 | 27 | 0 |
| Corrosion Prevention Properties, ASTM D1743 | Pass 1 | Pass 1 | Pass 1 | Pass 1 |
| Copper Strip Corrosion, ASTM D4048, 300° F., 24 hr. | 1A | 1A | 1A | 1A |
| Steel Strip Corrosion, 300° F., 24 hr. | No Discoloration | | | |
| Low Temperature Torque Test, ASTM D1478 at −10° F. | | | | |
| Starting Torque, gram-cm | 3,540 | 3,686 | 5,753 | 3,983 |
| Running Torque, gram-cm | 295 | 443 | 443 | 295 |
| U.S. Steel Grease Mobility Test, S-75, at −10° F., grams/minute | | | | |
| 50 PSI | 0.87 | 0.55 | 0.47 | 0.58 |
| 100 PSI | 4.96 | 3.99 | 2.65 | 2.78 |
| 150 PSI | 8.67 | 7.60 | 4.89 | 4.58 |
| Panel Stability Test at 350° F. for 24 hr. | No oil separation<br>Remained grease-like<br>No lacquer deposition | | | |

All polymers except the Functional V-157Q improved (hardened) the grease consistency as shown by the worked penetrations. The Functional V-157Q had no effect. The Functional V-157Q polymer significantly reduced the water resistance of the grease as measured by the Water Washout Test. The polymethacrylate polymer (TC 9355) and the ethylene-propylene copolymer (Functional V-157Q) increased the oil separation properties somewhat compared to the grease of Example 34 which contained no polymer. The Paratac of Example 37 reduced oil separation at the lowest test temperature but this effect dropped off as the test temperature increased.

All of the greases had good dropping points, extreme pressure/antiwear properties, and corrosion, oxidative, and rust preventative properties. None of the polymers caused any high temperature chemical corrosion to copper or steel as shown by the ASTM D4048 Copper Strip Corrosion Test and the Steel Strip Corrosion Test (similar to ASTM D4048 except that a polished steel strip is used instead of a copper strip). High temperature grease stability was measured by the Panel Stability Test, the details of which are described in Example 38. All four greases gave comparable results, indicating the superior high temperature stability of polyurea greases, the additional beneficial effect of the tricalcium phosphate and calcium carbonate additive system.

When measured by ASTM D1478 Low Temperature Torque, Example 36 which contained the ethylene-propylene copolymer (Functional V-157Q) gave the largest overall increase in torque when compared to the control grease of Example 34. Example 35 gave the smallest overall torque of the three greases which contained polymers. When the greases of Examples 34–37 were tested by the U.S. Steel Mobility Test, S-75, the polymethacrylate (TC 9355) was significantly superior to either ethylene-propylene copolymer (Functional V-157Q) or Paratac. This is evidenced by the minimal amount by which mobility decreased for Example 35 compared to the control grease of Example 34. Compared to Example 34, Example 35 had a mobility at 150 PSI which was reduced by 12% compared to Example 34. Example 36 and Example 37 had mobility reductions at 150 PSI of 44% and 47%, respectively, when compared to Example 34.

The greases of Examples 34–37 were also examined for adherence properties. The control grease of Example 34 had the least amount of adherence. Examples 35 and 36 were significantly increased in adherence; Example 37 was less adherent than Examples 35 and 36.

EXAMPLE 38

A steel mill grease was made by a procedure similar to that given in Example 17. However, several changes were made in the type and amount of additives added to the polyurea base grease. The grease had the following composition:

| Component | % (wt) |
|---|---|
| 850 SUS Oil | 45.48 |
| 350 SUS Oil | 30.32 |
| Polyurea Thickener | 12.50 |
| Tricalcium Phosphate | 2.00 |
| Calcium Carbonate | 2.00 |
| TC 9355 | 4.00 |
| OLOA 9750 | 1.00 |
| Zinc Naphthenate | 1.00 |
| Nasul BSN | 1.00 |
| Lubrizol 5391 | 0.50 |
| Aryl Amines | 0.20 |

The grease was tested and had the following base properties:

| | |
|---|---|
| Work Penetration, ASTM D217 | 318 |
| Dropping Point, ASTM D2265, °F. | 496 |
| Four Ball Wear, ASTM D2266 at 40 kg, 1200 rpm for 1 hr | 0.43 |
| Four Ball EP, ASTM D2596 | |
| last nonseizure load, kg | 80 |
| weld load, kg | 250 |
| load wear index | 42 |

The steel mill grease of Example 38 was further tested for extreme pressure and wear resistance properties by the Optimol SRV Test, low temperature flow properties by the Low Temperature Torque Test, resistance to water by the Water Washout Test, resistance to rusting under wet conditions by the Corrosion Prevention Properties Test, resistance to oil separation by the SDM-433 Oil Separation Test, and resistance to high temperature breakdown by Panel Stability Test. The latter test involves applying a film of controlled thickness to a stainless steel panel. A draw-down bar and appropriately sized template is used to accomplish the controlled film thickness 0.065 inches. The steel panel is then bent into a 30° bend and placed in an aluminum pan. The entire assembly is then placed in an oven at the temperatures and for the time indicated below. The assembly is then removed and allowed to cool to room temperature. The film of grease is then evaluated for hardness and consistency. Any oil separation or drainage from the grease film is noted. Also, any sliding of grease from the steel panel to the aluminum pan is noted. This test procedure is well known and commonly used by those practiced in grease technology and is often used to measure how a grease will hold up when exposed to very high temperatures. Test results are given below.

| | |
|---|---|
| Optimol SRV Stepload Test, Newtons | 1,000 |
| Low Temperature Torque Test, ASTM D1478 at −10° F., | |
| Starting Torque, gram-cm | 5,310 |
| Running Torque, gram-cm | 443 |
| Water Washout, ASTM D1264 at 170° F., % loss | 7.0 |
| Corrosion Prevention Properties, ASTM D1743 | 1 |
| Oil Separations, SDM 433, % | |
| 24 hr, 212° F. | 3.4 |
| 24 hr, 300° F. | 2.1 |
| 24 hr, 350° F. | 2.0 |
| Panel Stability Test at 350° F. for 24 hr. | All grease remained on the panel. There was no oil separation. The grease remained unctuous, smooth and pliable. There was no lacquer formation. |
| Copper Strip Corrosion, ASTM D4048, 24 hr, 300° F. | 1A |
| Steel Strip Corrosion, 24 hr, 300° F. | No Discoloration |

Results were very good. A very high maximum passing load on the Optimol SRV test indicated excellent extreme pressure and wear resistance properties. Oil separation was low especially at the high temperatures. Acceptable water washout results and good corrosion/-rust prevention properties were obtained. Low temperature torque at −10° F. was good. The most impressive results were obtained on the Panel Stability Test at 350° F. Even after 24 hours the grease remained pliable and smooth. There was no oil separation and no lacquer formation on or within the grease or on the steel panel. The grease was completely non-aggressive, non-reactive, and non-corrosive to both copper and steel, even after 24 hours at 300° F.

EXAMPLE 39

Yet another grease similar to those of Examples 34–37 was prepared. This time, however, the Nasul BSN and Zinc Naphthenate was replaced by Nasul BSN HT, manufactured by King Industries Specialty Chemicals, and Vanlube RI-G, manufactured by R. T. Vanderbilt Company, Inc. The Nasul BSN HT is a barium dinonylnaphthalene sulfonate further stabilized by a complexing agent. The Vanlube RI-G is an imidazoline material. Final grease composition is given below.

| Component | % (wt) |
|---|---|
| 850 SUS Oil | 46.98 |
| 350 SUS Oil | 31.32 |
| Polyurea Thickener | 10.00 |
| Tricalcium Phosphate | 2.00 |
| Calcium Carbonate | 2.00 |
| TC 9355 | 4.00 |
| OLOA 9750 | 1.00 |
| Vanlube RI-G | 0.50 |
| Nasul BSN HT | 1.50 |
| Lubrizol 5391 | 0.50 |
| Aryl Amines | 0.20 |

The grease was tested in a manner similar to Examples 34–37 and the following results were obtained.

| | |
|---|---|
| Worked Penetration, ASTM D217 | 345 |
| Dropping Point, ASTM D2265, °F. | 520+ |
| Four Ball Wear, ASTM D2266 at 40 kg, 1200 rpm for 1 hr | 0.42 |
| Four Ball EP, ASTM D2596 | |
| last nonseizure load, kg | 80 |
| weld load, kg | 315 |
| load wear index | 39.7 |
| Optimol SRV Stepload Test, Newtons | 600 |
| Low Temperature Torque Test, ASTM D1478 at −10° F., | |
| Starting Torque, gram-cm | 3,393 |
| Running Torque, gram-cm | 148 |
| U.S. Steel Grease Mobility Test, S-75, at −10° F., grams/minute | |
| 50 PSI | 1.86 |
| 100 PSI | 8.51 |
| 150 PSI | 15.0 |
| Water Washout, ASTM D1264 at 170° F., % loss | 11.0 |
| Corrosion Prevention Properties, ASTM D1743 | Pass 1 |
| Corrosion Prevention Properties, ASTM D1743, 5% Synthetic Sea Water | Pass 1 |
| Oil Separations, SDM 433, % | |
| 24 hr, 212° F. | 6.5 |
| 24 hr, 300° F. | 4.3 |
| 24 hr, 350° F. | 4.4 |
| Panel Stability Test at 350° F. for 24 hr. | All grease remained on the panel. There was no oil separation The grease remained unctuous, smooth and pliable. There was no lacquer formation. |
| Copper Strip Corrosion, ASTM D4048, 24 hr, 300° F. | 1A |
| Steel Strip Corrosion, 24 hr, 300° F. | No Discoloration |

Results are similar to that of Example 35. Example 39 also gave an acceptable passing result on the ASTM D1743 Corrosion Prevention Properties Test when modified to include 5% of a synthetic sea water solution.

EXAMPLE 40

Another steel mill grease was made similar to the one of Example 38. However, this time a different blend of base oils was used to produce a higher viscosity base oil blend in the final grease. This was accomplished by using paraffinic bright stock as a third, higher viscosity base oil. The bright stock had a viscosity of about 750 cSt at 40° C. The grease was evaluated in a manner similar to Example 38. Final grease composition and test data are given below:

| Component | % (wt) |
|---|---|
| 850 SUS Oil | 30.64 |
| 350 SUS Oil | 30.64 |
| Bright Stock | 15.32 |
| Polyurea Thickener | 12.00 |
| Tricalcium Phosphate | 2.00 |
| Calcium Carbonate | 2.00 |
| TC 9355 | 4.00 |
| OLOA 9750 | 1.00 |
| Zinc Naphthenate | 1.00 |
| Nasul BSN | 1.00 |
| Lubrizol 5391 | 0.50 |
| Aryl Amines | 0.20 |

The grease was tested in a manner similar to Example 38 and the following results were obtained.

| | |
|---|---|
| Work Penetration, ASTM D217 | 324 |
| Dropping Point, ASTM D2265, °F. | 500 |
| Four Ball Wear, ASTM D2266 at 40 kg, 1200 rpm for 1 hr | 0.45 |
| Four Ball EP, ASTM D2596 | |
| last nonseizure load, kg | 80 |
| weld load, kg | 250 |
| load wear index | 36.85 |
| Optimol SRV Stepload Test, Newtons | 1,100 |
| Low Temperature Torque Test, ASTM D1478 at −10° F., | |
| Starting Torque, gram-cm | 7,375 |
| Running Torque, gram-cm | 590 |
| Water Washout, ASTM D1264 at 170° F., % loss | 3.8 |
| Corrosion Prevention Properties, ASTM D1743 | Pass 1 |
| Oil Separations, SDM 433, % | |
| 24 hr, 212° F. | 4.9 |
| 24 hr, 300° F. | 3.4 |
| 24 hr, 350° F. | 5.9 |
| Panel Stability Test at 350° F. for 24 hr. | All grease remained on the panel. There was no oil separation The grease remained unctuous, smooth and pliable. There was no lacquer formation |
| Copper Strip Corrosion, ASTM D4048, 24 hr, 300° F. | 1A |
| Steel Strip Corrosion, 24 hr, 300° F. | No Discoloration |

Results are similar to that of Example 38, showing the same excellent qualities.

EXAMPLES 41–42

Samples of two commercially available prior art steel mill greases, an aluminum complex thickened grease and a lithium complex steel mill grease, were obtained and evaluated in a manner similar to the steel mill grease of Example 38. The lithium complex thickened grease was sold by Chemtool Incorporated under the trade name Rollube EP-1. The aluminum complex thickened grease was sold by Brooks Technology under the trade name Plexalene Grease No. 725. Test data is tabulated below.

| Test Grease | 41 | 42 |
|---|---|---|
| Thickener Type | Aluminum Complex | Lithium Complex |
| Work Penetration, ASTM D217 | 303 | 305 |
| Dropping Point, ASTM D2265 | 511 | 545 |
| Optimol SRV Stepload Test, Newtons | 600 | 400 |
| Low Temperature Torque Test, ASTM D1478 at −10° F. | | |
| Starting Torque, gram-cm | 4,278 | 2,950 |
| Running Torque, gram-cm | 1,133 | 1,033 |
| Water Washout, ASTM D1264 at 170° F., % loss | 14 | 3.0 |
| Corrosion Prevention Properties, ASTM D1743 | Fail 3 | Pass 1 |
| Oil Separations, SDM 433, % | | |
| 24 hr, 212° F. | 0.9 | 4.2 |
| 24 hr, 300° F. | 4.6 | 11.0 |
| 24 hr, 350° F. | 17.5 | 24.8 |
| Copper Strip Corrosion, ASTM D4048, 24 hr, 300° F. | 4A (Black) | 4B (Black) |
| Steel Strip Corrosion, 24 hr, 300° F. | Black | Black |
| Panel Stability Test at at 350° F. for 24 hr. | Most slid off. Lacquer-hard coating remained. | Grease turned lacquer-hard. |

-continued

| Test Grease | 41 | 42 |
|---|---|---|
| | remained. | |

Both the prior art, conventional aluminum complex and lithium complex steel mill greases gave poor high temperature oil separation results despite their tacky texture. The lithium complex grease was especially poor in this regard. Optimol SRV results for both were much lower than the grease of Example 38, indicating the superior extreme pressure and wear resistance properties of Example 38. Example 41 was also inferior on Water Washout Test, ASTM D1264 and miserably failed the Corrosion Prevention Properties Test. Both greases were inferior to Example 38 in the low temperature running torque. Both greases were chemically corrosive to copper and steel at 300° F. This is especially bad since grease temperatures will greatly exceed temperatures of 300° F. in continuous slab casters. The lacquering effect so often a problem with aluminum complex and lithium complex thickened greases was very obvious in the greases of Examples 41 and 42. Unlike the grease of Example 38, the greases of both Example 41 and 42 exhibited severe lacquering in the Panel Stability Test.

EXAMPLES 43–44

Two more commercial prior art, conventional steel mill greases, a lithium 12-hydroxystearate thickened grease and an aluminum complex thickened grease, were evaluated in a manner similar to Examples 41 and 42. The lithium 12-hydroxystearate grease was sold by Chemtool Incorporated under the trade name of Casterlube. The aluminum complex grease was sold by Magee Brothers. Test data is tabulated below.

| Test Grease | 43 | 44 |
|---|---|---|
| Thickener Type | Lithium 12-HSt | Aluminum Complex |
| Work Penetration, ASTM D217 | 303 | 316 |
| Dropping Point, ASTM D2265 | 380 | 500+ |
| Optimol SRV Stepload Test, Newtons | 200 | 500 |
| Low Temperature Torque Test, ASTM D1478 at −10° F. | | |
| Starting Torque, gram-cm | 5,753 | 4,278 |
| Running Torque, gram-cm | 443 | 1,180 |
| Water Washout, ASTM D1264 at 170° F., % loss | 10.0 | 9.3 |
| Corrosion Prevention Properties, ASTM D1743 | Pass 1 | Fail 3 |
| Oil Separations, SDM 433, % | | |
| 24 hr, 212° F. | 6.7 | 3.1 |
| 24 hr, 300° F. | 11.2 | 6.8 |
| 24 hr, 350° F. | 41.8 | 16.4 |
| Copper Strip Corrosion, ASTM D4048, 24 hr, 300° F. | 1A | 4B (Black) |
| Steel Strip Corrosion, 24 hr, 300° F. | No Discoloration | Black |
| Panel Stability Test at 350° F. for 24 hr. | Most slid off. Lacquer-hard coating remained. | Most slid off Lacquer-hard coating remained. |

Both the lithium 12-hydroxystearate and aluminum complex thickened steel mill greases gave inferior high temperature oil separation results despite their tacky texture. The lithium 12-HSt grease was especially unsatisfactory in this regard. Optimol SRV results for both were much lower than the grease of Example 38, indicating the superior extreme pressure and wear resistance properties of Example 38. Examples 43 and 44 were also inferior in Water Washout Test, ASTM D1264 and Example 44 failed the Corrosion Prevention Properties Test. Both greases were overall inferior in Example 38 in the Low Temperature Torque Test. The grease of Example 44 was chemically corrosive to copper and steel at 300° F. This is very troublesome since grease temperatures will greatly exceed temperatures of 300° F. in continuous slab casters. Although the grease of Example 43 was not chemically corrosive to copper or steel, it had virtually no extreme pressure/antiwear properties, as shown by the very low maximum passing load on the Optimol SRV Step Load Test. The lacquering effect so often a problem with aluminum complex and lithium complex thickened greases was very apparent in the greases of Example 43 and 44. Unlike the grease of Example 38, the greases of Example 43 and 44 exhibited severe lacquering in the Panel Stability Test.

EXAMPLE 45

A 25,000 pound commercial batch of steel mill grease with composition similar to that of Example 38 was prepared. The major difference between this grease and that of Example 38 was in the milling step. In Example 38, the polymeric additive was blended into the grease with all the rest of the additives before any milling had occurred. In Example 45, the grease was cyclically milled for two average passes without the polymeric additive present. Just before the final milling pass, when the grease would be milled out into containers, the polymeric additive was added and blended into the grease by stirring. Then the final grease was milled out. By this procedure the polymeric additive only experienced one pass through the Gaulin homogenizer. The resulting grease was evaluated by various bench tests; results are tabulated below:

| | |
|---|---|
| Worked Penetration, ASTM D217 | 313 |
| Dropping Point, ASTM D2265 | 526 |
| Oil Separations, SDM 433, % | |
| 24 hr, 212° F. | 3.8 |
| 24 hr, 300° F. | 3.4 |
| 24 hr, 350° F. | 4.9 |
| Oil Separation During Storage, ASTM D1742, % | 0.62 |
| Four Ball Wear, ASTM D2266 at 40 kg, 1200 rpm for 1 hr | 0.50 |
| Four Ball EP, ASTM D2596 | |
| Last Nonseizure Load, kg | 80 |
| Weld Load, kg | 250 |
| Load Wear Index | 40.1 |
| Fretting Wear, ASTM D4170, 24 hr mg loss/race set | 0 |
| Optimol SRV Stepload Test, Newtons | 1,200 |
| Optimol SRV Stepload Test, w/5% water, Newtons | 1,100 |
| Water Washout, ASTM D1264 at 170° F., % loss | 0 |
| Corrosion Prevention Properties, ASTM D1743 | Pass 1 |
| Copper Strip Corrosion, ASTM D4048, 24 hr, 300° F. | 1A |
| Copper Strip Corrosion, ASTM D4048, 24 hr, 400° F. | 1A |
| Steel Strip Corrosion, 24 hr, 300° F. | No Discoloration |
| Steel Strip Corrosion, 24 hr, 400° F. | No Discoloration |
| Low Temperature Torque Test, ASTM D1478 at −10° F. | |
| Starting Torque, gram-cm | 5,163 |

-continued

| | |
|---|---|
| Running Torque, gram-cm | 295 |
| U.S. Steel Grease Mobility Test, S-75, at −10° F., grams/minute | |
| 50 PSI | 0.47 |
| 100 PSI | 2.40 |
| 150 PSI | 5.26 |
| Panel Stability Test at 350° F for 24 hr. | All grease remained on the panel. There was no oil separation. The grease remained unctuous, smooth and pliable. There was no lacquer formation. |

As the test data indicates the novel steel mill grease of Example 45 had all the aforementioned desirable properties without any of the flaws of the prior art greases of Examples 41–44. Oil separation properties of the novel steel mill grease of Example 45 were excellent, even at high temperatures. Good extreme pressure properties were obtained with the steel mill grease of Example 45 while at the same time avoiding any corrosive tendencies towards copper or steel. Significantly, the grease provided excellent non-corrosive properties and was non-corrosive to copper and steel even at 400° F. The grease of Example 45 was far more non-corrosive at 400° F. than previously described prior art greases at 300° F. Desirably, the grease of Example 45 had excellent rust prevention, resistance to water displacement, and thermal stability, as indicated by the Panel Stability Tests. No tendency towards lacquer deposition was observed. Low temperature properties were good. The grease also had good adhesive-imparting properties.

EXAMPLE 46

Another batch of steel mill grease similar to that of Example 45 was prepared and evaluated for elastomer compatibility. Test results are given below:

| | |
|---|---|
| Elastomer Compatibility with Polyester | |
| % loss tensile strength | 25.6 |
| % loss maximum elongation | 15.6 |
| Elastomer Compatibility with Silicone | |
| % loss tensile strength | 30.6 |
| % loss maximum elongation | 22.8 |

These results taken with the previous test results given in Example 45 establish this novel grease to be well suited for use in general process purpose applications within steel mills.

EXAMPLE 47

The grease of Example 45 was tested by a large midwestern steel manufacturer and achieved spectacular results: (1) a total elimination of all lubricant-related bearing failures and (2) an 81% reduction in grease consumption. Advantageously, the grease of Example 45 formed a hermetic seal around the edges of the mechanical seals and housings of the bearings and eliminated leakage of grease. Also, the amount of water mixed in the grease of Example 45 within the bearings was dramatically reduced compared to the water levels in the prior art conventional grease which had been previously used. Water levels in grease went from more than 30% to about 3% when the grease of Example 45 was used.

EXAMPLE 48

The inventive steel mill grease of Example 47 was tested in a test for flame resistance. In the ignition test a rounded ridge of grease is formed by careful use of a stainless steel spatula. The ridge is formed on the center of a large circular steel lid to a five gallon pail. The ridge is approximately ¾ inch wide at the base and ¾ inch high at the top. The ridge is rounded in cross sectional contour. On top of the grease ridge is placed a match from an ordinary paper matchbook. The match is perpendicular to the direction of the grease ridge so that the match head is on one side of the ridge. The match is also centered so that an equal length is on either side of the central axis of the match ridge. The match is then lit with another lighted match while shielding (blocking) the flame from surrounding air flow (air currents). As the flame progresses down the match it eventually contacts the grease.

The grease of Example 47 was repeatedly tested with the above test. During the test the flame went out when the flame touched the grease. It generally took between four to six attempts to ignite the grease. When the grease ignited, it slowly burned until only oil was left and then the flame went out. The oil did not ignite.

EXAMPLE 49

The prior art aluminum complex grease of Example 41 was tested using the test procedure described in Example 48. The grease immediately ignited and burned profusely as soon as the flame contacted the grease.

EXAMPLE 50

The prior art lithium complex grease of Example 42 was tested using the test procedure described in Example 48. The grease immediately ignited and burned as soon as the flame contacted the grease.

EXAMPLE 51

The conventional lithium 12-hydroxystearate grease of Example 43 was tested using the test procedure described in Example 48. The grease melted and flowed when the flame contacted the grease. When enough grease had melted away from the lit portion of the match, the match slumped over until it hit the surface of the steel lid. When this occurred, the flame was no longer in contact with grease and subsequently became extinguished.

EXAMPLE 52

The prior art aluminum complex grease of Example 44 was tested using the test procedure described in Example 48. The grease immediately ignited and burned as soon as the flame contacted the grease.

EXAMPLE 53

To better measure the ignition resistance of grease, the greases were tested with an ignition resistance test. In the ignition resistance test, a six inch diameter petri dish is filled with the grease to be tested. The surface of the grease is struck flush with the glass petri dish so that a substantially flat circular surface of grease is obtained. A paper match is placed in the center of the grease so that it is perpendicular to the grease surface with the match head just above the grease surface. This match is referred to as the fuse match. Another match is placed flat on the grease surface so that its head is up against the base of the fuse match. The fuse match is lit and as the flame progresses down, it lights the other match. If the matches go out without igniting the grease, then the test is repeated. This time two matches are placed flat on the grease surface with both of their heads up against the base of the fuse match. The matches which are flat on the grease surface are always placed so that they extend out from each other by a maximum amount. In the case of two, they extend at an angle of 180°. The fuse match is lit and it in turn lights the two base matches, causing an even larger initial flame on the surface of the grease then was produced by one base match. In this way the test is repeated, adding more and more matches until the grease ignites and begins to burn. The number of matches required to ignite the grease is a measure of the flammability and ignition resistance of the grease.

The inventive steel mill grease of Example 47 was tested with the above test procedure and failed to ignite and burn even when eight base matches were placed around the fuse match. This test was repeated several times with the same result.

EXAMPLE 54

The prior art aluminum complex grease of Example 41 was tested by the test procedure described in Example 53. Ignition failed to occur with one base match. With two base matches, however, the grease ignites and begins to burn as oil begins to separate on the grease surface.

EXAMPLE 55

The prior art lithium complex grease of Example 42 was tested by the test procedure described in Example 53. Ignition failed to occur with one and two base matches. With three base matches, however, the grease ignited and burned as oil began to separate on the grease surface.

EXAMPLE 56

The conventional lithium 12-hydroxystearate grease of Example 43 was tested by the test procedure described in Example 53. Ignition failed to occur with one base match. With two base matches, however, the grease ignited and burned as oil began to separate on the grease surface. The separated oil formed a pool on the surface of the grease under the base matches. The base matches acted as a wick and continue to burn, being fed by the hot oil from the grease.

EXAMPLE 57

The prior art aluminum complex grease of Example 44 was tested by the test procedure described in Example 53. Results are similar to that described in Example 54.

EXAMPLE 58

During extensive testing of the inventive grease of Example 47 over a 16-month period in a large midwestern steel mill, no grease fires occurred in contrast to conventional greases which had frequently caused fires in the steel mill. Performance of the novel grease was outstanding.

Among the many advantages of the novel steel mill grease and process are:

1. High performance of slab casting units in steel mills as well as other processing units in steel mills.

2. Longer life in the caster bearings in steel mills and substantial reduction in grease consumption.

3. Superior flame and ignition resistance.

4. Excellent resistance to displacement by water.

5. Outstanding protection against rusting even under prolonged exposure to water.

6. Superior non-corrosivity to copper, iron, and steel at prolonged high temperatures.

7. Excellent extreme pressure and wear resistance properties.

8. Oxidatively and thermally stable at high temperatures and at lower temperatures.

9. Prevention of lacquer-like deposits.

10. Excellent pumpability at low temperatures.

11. Remarkable compatibility and protection of elastomers and seals.

12. Excellent oil separation qualities, even at high temperatures.

13. Nontoxic

14. Safe

15. Economical

Although embodiments of this invention have been described, it is to be understood that various modifications and substitutions, as well as rearrangements of process steps, can be made by those skilled in the art without departing from the novel spirit and scope of this invention.

What is claimed is:

1. A process, comprising the steps of:

processing metal in a mill selected from the group consisting of a steel mill, hot strip mill, cold strip mill, billet mill, plate mill, and rod mill, by casting, forming, treating, fabricating, or working said metal;

conveying said metal on caster rollers, said caster rollers having bearings;

substantially enhancing the longevity and useful life of said bearings and substantially protecting said bearings against rust and corrosion by injecting into said bearings a grease comprising at least one extreme pressure additive selected from the group consisting of a phosphate of a Group 1A alkali metal, a phosphate of a Group 2A alkaline earth metal, a carbonate of a Group 1A alkali metal, and a carbonate of a Group 2A alkaline earth metal and a non-corrosive thermally stable polymer for substantially resisting corrosion at high temperatures during fabricating of said metal; and substantially preventing said grease from leaking out of said bearings.

2. A process in accordance with claim 1 including spraying water on said bearings and said metal to cool said metal while substantially preventing said grease from washing out of said bearings.

3. A process in accordance with claim 1 wherein said polymer comprises at least one member selected from the group consisting of: polyesters, polyamides, polyurethanes, polyoxides, polyamines, polyacrylides, polyvinyl alcohol, ethylene vinyl acetate, polyvinyl pyrolidine, polyolefins, polyolefin arylenes, polyarylenes, polymethacrylate, and boronated compounds thereof.

4. A process in accordance with claim 3 wherein said phosphate comprises tricalcium phosphate and said carbonate comprises calcium carbonate.

5. A process in accordance with claim 4 wherein said grease further comprises a polyurea thickener, a base oil, and a boron-containing oil-separation inhibitor.

6. A process, comprising the steps of:

processing metal in a mill selected from the group consisting of a steel mill, hot strip mill, cold strip mill, billet mill, plate mill, and rod mill, by casting, forming, treating, fabricating, or working said metal;

conveying said metal or caster rollers, said caster rollers having bearings;

substantially enhancing the longevity and useful life of said bearings and substantially protecting said bearings against rust and corrosion by injecting into said bearings a grease comprising at least one extreme pressure additive selected from the group consisting of a phosphate of a Group 1A alkali metal, a phosphate of a Group 2A alkaline earth metal, a carbonate of a Group 1A alkali metal, and a carbonate of a group 2A alkaline earth metal and a non-corrosive thermally stable polymer for substantially resisting corrosion at high temperatures during fabricating of said metal;

substantially preventing ignition of said grease at said high temperatures during fabrication of said metal by emitting carbon dioxide from said grease about said bearings; and substantially preventing said grease from leaking out of said bearings.

7. A process in accordance with claim 6 wherein said carbonate comprises calcium carbonate.

8. A process, comprising the steps of:

feeding molten steel to a formation chamber of a steel mill;

forming and discharging an elongated hot steel slab from said formation chamber;

discharging said hot steel slab on a slab caster;

conveying said hot steel slab on caster rollers having roller bearings;

lubricating said bearings with a high performance grease, said grease comprising a polyurea thickener, a base oil, extreme pressure wear-resistant additives comprising calcium carbonate and tricalcium phosphate, and a substantially water-resistant, thermally stable, high temperature non-oxidative, adhesive-imparting polymer;

quenching said hot steel slab on said caster rollers by spraying water on said hot steel slab and said bearings; and substantially preventing said grease from being flushed out of said bearings by said water spray.

9. A process in accordance with claim 8 wherein said polymer comprises at least one member selected from the group consisting of: polyesters, polyamides, polyurethanes, polyoxides, polyamines, polyacrylamides, polyvinyl alcohol, ethylene vinyl acetate, polyvinyl acetate, polyvinyl pyrrolidone, polyolefins, polyolefin arylenes, polyarylenes, polymethacrylate, and boronated compounds thereof.

10. A process in accordance with claim 8 wherein said comprises by weight: from about 6% to about 16% polyurea thickener, from about 45% to about 85% base oil, from about 2% to about 30% extreme pressure wear-resistant additives, from about 0.1% to about 5% of an oil separation inhibitor comprising a boron-containing compound, and from about 1% to about 10% of said polymer, and said polymer is selected from the group consisting of polyethylene, polypropylene, polyisobutylene, ethylene propylene, ethylene butylene, ethylene styrene, styrene isoprene, polystyrene, polymethacrylate, and combinations thereof.

11. A process in accordance with claim 10 wherein said grease comprises by weight: from about 8% to about 14% polyurea, at least about 70% base oil, from about 4% to about 16% of said extreme pressure wear-resistant additives, and from about 0.25% to about 2.5% oil separation inhibitor, and from about 2% to about 6% of said polymer, and said polymer comprises polymethacrylate.

* * * * *

UNITED STATES PATENT AND TRADEMARK OFFICE

CERTIFICATE OF CORRECTION

PATENT NO. : 5,000,862

DATED : March 19, 1991

INVENTOR(S) : John A. Waynick

It is certified that error appears in the above-identified patent and that said Letters Patent is hereby corrected as shown below:

| Col. | Line | |
|---|---|---|
| 9 | 53 | "$3Ca_3(PO_{42}\cdot Ca(OH)_2$" should read --$3Ca_3(PO_4)_2\cdot Ca(OH)_2$--. |
| 16 | 26 | "catalyst reactants" should read --catalyst and is initiated by merely contacting the component reactants--. |
| 23 | 5 | "additive In" should read --additive. In-- |
| 26 | 47 | "ar" should read --are--. |
| 31 | 22 | "separation" should read --separation.--. |
| 32 | 25 | "Example" should read --Examples--. |
| 33 | 17 | "Example" should read --Examples--. |
| 36 | 49 | "Continue" should read --Continued--. |

Signed and Sealed this

Fifteenth Day of June, 1993

Michael K. Kirk

MICHAEL K. KIRK

*Acting Commissioner of Patents and Trademarks*

*Attest:*

*Attesting Officer*